United States Patent [19]

Rivoire

[11] 4,205,494

[45] Jun. 3, 1980

[54] RAIL GRINDING APPARATUS

[75] Inventor: Albert Rivoire, North Syracuse, N.Y.

[73] Assignee: Speno Rail Services, Inc., Lincolnshire, Ill.

[21] Appl. No.: 4,260

[22] Filed: Jan. 18, 1979

[51] Int. Cl.[2] ..... B24B 23/00

[52] U.S. Cl. ..... 51/178

[58] Field of Search ..... 51/178, 241 LG

[56] References Cited

U.S. PATENT DOCUMENTS

| | | | |
|---|---|---|---|
| 2,779,141 | 1/1957 | Speno, Jr. | 51/178 |
| 3,358,406 | 12/1967 | Speno, Jr. | 51/178 |
| 3,562,959 | 2/1971 | Dooley, Jr. | 51/178 |
| 3,606,705 | 9/1971 | Rivoire | 51/178 |
| 3,738,066 | 6/1973 | Panetti | 51/178 |
| 3,818,650 | 6/1974 | Behne | 51/178 |
| 3,918,215 | 11/1975 | Scheuchzer | 51/178 |

FOREIGN PATENT DOCUMENTS

| | | | |
|---|---|---|---|
| 330864 | 6/1930 | United Kingdom | 51/178 |

*Primary Examiner*—Othell M. Simpson
*Assistant Examiner*—Roscoe V. Parker
*Attorney, Agent, or Firm*—Joel E. Siegel; Charles M. Kaplan

[57] ABSTRACT

Vehicle-mounted rail grinding apparatus has circular rail grinding discs mounted on a massive platform that is supported by hydraulic pistons and cylinders located at or adjacent the centers of gravity of the platform and vehicle carriage. This permits universal relative movement of the vehicle carriage and platform so that the vertical position of the discs is independent of the movement of the vehicle carriage caused by undulations and other imperfections in the rails.

11 Claims, 3 Drawing Figures

RAIL GRINDING APPARATUS

BACKGROUND OF THE INVENTION

This invention relates to rail grinders and more particularly to rail grinders mounted on a vehicle that travels along the rails as they are being ground.

As railroad rails wear, crests and troughs are formed which define irregular waves extending longitudinally off the tracks. When the length of such waves is greater than the diameter of the circular grinding wheels used to smooth the rails, the rail grinding apparatus will follow the waves; this results in as much material being ground from the troughs as is ground from the crests. Though attempts have been made to solve this problem, the prior grinding apparatus followed the waves because the grinding discs were not mounted for movement that is essentially completely independent of the vertical movement of the rail carriage.

OBJECTIVES OF THE INVENTION

Accordingly, it is an object of this invention to provide an improved rail grinder.

Another object is to provide a vehicle-mounted rail grinder that does not move up and down with the vehicle as it travels over the rails.

Another object is to support rail grinding discs so that they pass over the troughs of the waves in the rails, but will plough through the crests of such waves.

Another object is to mount railroad track grinding heads on the platform supported so as to float about its center of gravity.

Another object is to provide for universal relative movement of a rail vehicle and rail grinding discs carried by such vehicle.

Another object is to provide rail grinders mounted on a platform that is supported only at its center of gravity with the ends of the platform being unattached to a vehicle that carries the assembly along the tracks being ground.

Another object is to provide a rail grinding assembly that is not caused to perform small rocking movements about the tracks undulation crests, since the assembly is not supported on such crests.

Another object is to provide rugged, durable, relatively low-cost, simplified rail grinding apparatus that does not possess defects found in prior art rail grinders.

Other objects and advantages of the invention will be found in the specification and claims, and the scope of the invention will be set forth in the claims.

DESCRIPTION OF THE INVENTION

Figure 1:
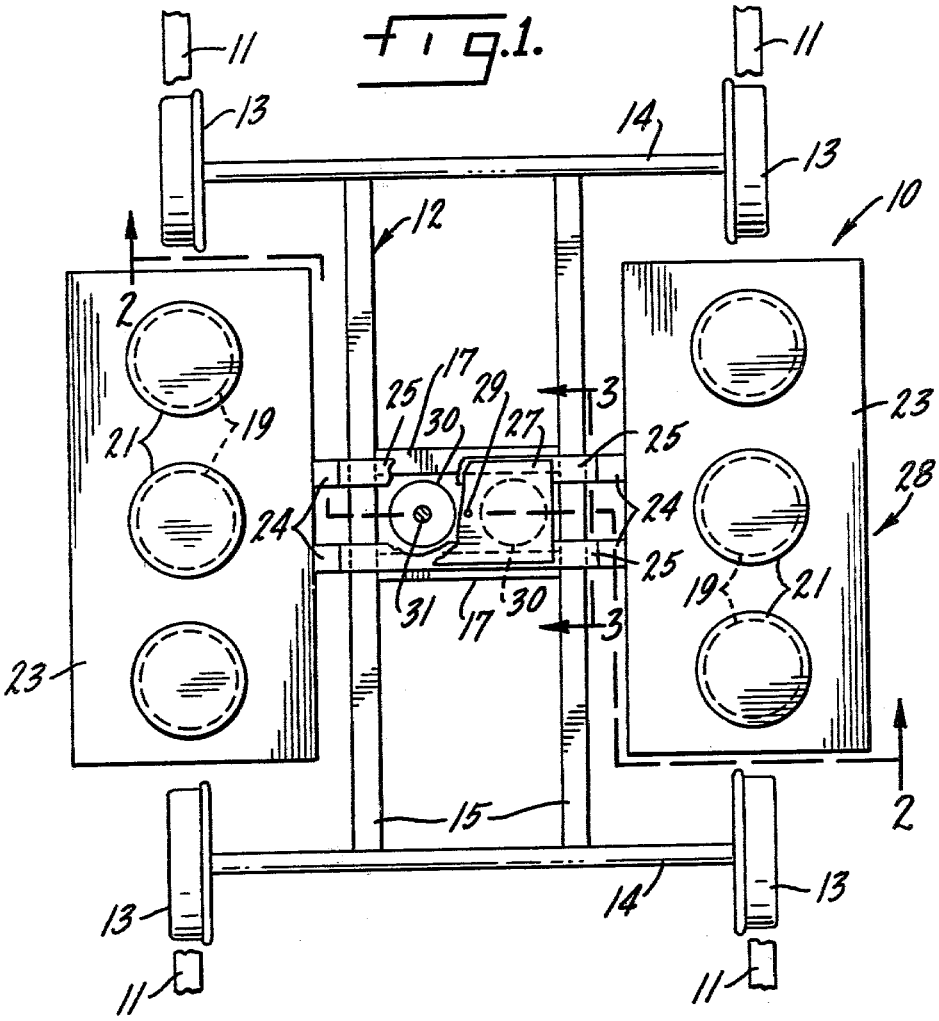
FIG. 1 is a schematic, partially broken-away top plan view of a rail grinder in accord with this invention.
Figure 2:
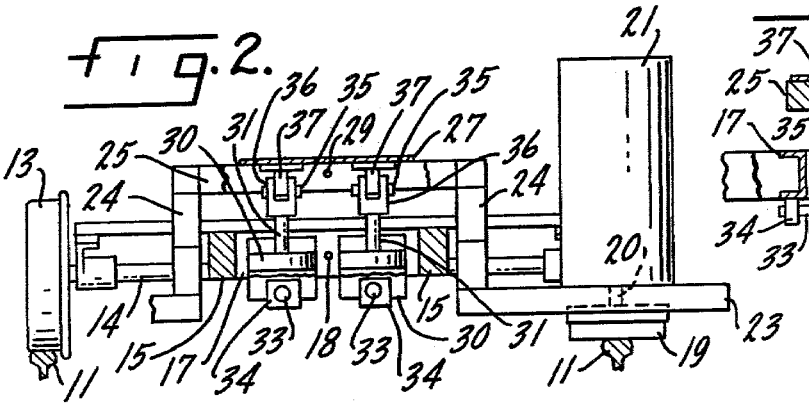
FIG. 2 is a partially broken-away end view taken along the line 2—2 in FIG. 1.

The drawing shows rail grinder apparatus 10 that travels along and grinds irregularities off the parallel railroad tracks or rails 11. A rigid vehicle carriage 12 that travels along rails 11 has two pair of wheels 13 mounted on axles 14 which are connected by a pair of longitudinal parallel beams 15. A pair of channel beams 17 connect beams 15, and the center of gravity 18 of carriage 12 occurs at the center of the space enclosed by beams 15 and 17. Carriage 12 is propelled by any conventional means and moves in response to the contour and position of rails 11. A plurality of circular rail grinding discs 19 are aligned between the wheels 13 on each side of carriage 12. Each disc 19 is mounted on a shaft 20 powered by a motor 21 so as to rotate about a vertical axis as it grinds rails 11 in conventional manner.

Motors 21 are mounted on a pair of parallel platforms 23 that extend between the wheels 13. Each platform 23 is attached to a pair of parallel upwardly extending struts 24. Each pair of struts 24 is attached to a pair of parallel transverse beams 25. The inner ends of the beams 25 are attached to an upper support plate 27. Thus grinding discs 19 are all mounted on a single platform assembly 28 defined by the individual platforms 23 and the struts 24, beams 25 and plate 27 which interconnect them. Platform assembly 28 is relatively massive with respect to each individual grinding disc 19 in that the weight of the platform assembly, including motors 21, is at least about one thousand times the weight of any disc 19. The center of gravity 29 of platform assembly 28 occurs at the center of plate 27, and the centers of gravity 18 and 29 are vertically aligned.

Grinding discs 19 are supported on vehicular carriage 12 so that they are independent of the movement of the vehicle caused by imperfections or undulations in the rails 11 upon which the vehicle is travelling. A pair of identical hydraulic cylinders 30 each contains a vertically movable mating piston 31. Cylinders 30 and pistons 31 are aligned equidistant from the centers of gravity 18 and 29 in the same transverse vertical plane containing such centers of gravity. Each cylinder 30 has its lower end hinged to a pair of channel beams 17 means of a longitudinally extending pin 33 that is rotatable in bearings 34. Each pin 33 is secured to the bottom of a cylinder 30 and bearings 34 are secured to beams 17. Each piston 31 has its upper end hinged to platform assembly 28 by means of a transversely extending pin 35 that is held in a yoke 36 attached to such piston. Each pin 35 passes through a hole in a lug 37 which is secured to the underside of plate 27. Thus, each cylinder 30 defines first means pivotally connected to carriage 12 that permits pivoting about the center of gravity 18 towards and away from rails 11. Similarly, pistons 31 define second means pivotally connected to platform 28 that permit pivoting about the center of gravity 29 towards and away from axles 14. The combined effect of the manner in which cylinders 30 and pistons 31 are connected to platform assembly 28 and carriage 12 permits universal movement between the platform assembly and carriage. It is also possible to connect cylinders 30 to carriage 12 and pistons 31 to platform 28 by ball-in-socket hinges. The pistons 31 are supported by oil or other hydraulic liquid in the bottom of cylinders 30 and air pressure is applied to the top of cylinders 30 above pistons 31. Oil and air under pressure may be supplied to cylinders 30 in any conventional manner that enables the pistons 31 to be locked into a fixed or static vertical position. The vertical position of the individual grinding discs 19 may be controlled by known hydraulic circuits, as for example by those shown in U.S. Pat. Nos. 2,779,141 and 3,606,705, both of which are assigned to the same assignee as this invention.

Figure 3:
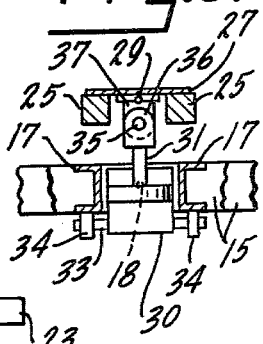
FIG. 3 is a side view taken along the line 3—3 in FIG. 1.

It has thus been shown that by the practice of this invention the massive platform assembly 28 is floatingly supported on hydraulic fluids by hinge connections at 33 and 35 that permit universal relative movement between assembly 28 and carriage 12. The undulating and irregular movements of carriage 12 caused by the imperfections in rails 11 are not transmitted to the grinding heads 19 because the centers of gravity 18 and 29 are vertically aligned in the same transverse plane containing cylinders 30 and pistons 31. The cylinders 30 and pistons 31 are located at the central portions of carriage 12 and assembly 28, and the sides and ends of assembly 28 are not attached to carriage 12. This prevents the assembly 28, and hence grinding discs 19, from being supported on the crests of the track undulations and eliminates small rocking movements of the discs 19 about such crests. When the rail grinder apparatus 10 encounters a track undulation crest, the leading wheels 13 ride up on to such crest and carriage 12 tilts upwardly. However, the cushion of fluid in cylinders 30 absorbs the upward movement and the upper end of each piston 31 pivots about its hinge pin 35. Thus, platform assembly 28 is not moved by such undulation crest and grinding discs 19 plough into the crest and grind it smooth. The relatively massive weight of assembly 28 enables it to remain unmoved or otherwise affected by the impact of one or more discs 19 with an undulation crest. Similarly, when leading wheels 13 dip into a trough in tracks 11, the downward movement of carriage 12 is not transmitted to assembly 28, and discs 19 pass above such troughs. Platform assembly 28 is also isolated from irregular movements caused by track imperfections lifting or lowering the wheels 13 on the side of apparatus 10 with respect to the wheels on the opposite side. It is also possible to support platform assembly 28 on carriage 12 with a single cylinder 30 and mating piston 31 extending directly between centers of gravity 18 and 29; such an arrangement would be otherwise identical to that shown herein and would appear in FIG. 3 exactly as the illustrated embodiment is depicted.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. Apparatus for grinding a pair of parallel rails, comprising:

A. a vehicle having two pairs of axle-mounted wheels that travel on said rails, means connecting said axles and defining a rigid vehicle carriage which moves in response to the contour and position of said rails;

B. a plurality of circular rail grinding discs, each of which rotates about a generally vertical axis, said discs being supported by a massive platform having its center of gravity vertically aligned with the center of gravity of said carriage; and C. means for supporting said grinding discs independently of the movement of said vehicle caused by imperfections in the surface of said rails, comprising;

1. first means having one end pivotally connected to said carriage permitting pivoting thereof about the center of gravity of said carriage;

2. second means having one end pivotally connected to said platform permitting pivoting of said platform about its center of gravity; and 3. said first and second means being interconnected so as to permit universal relative movement of said platform and carriage about said centers of gravity.

2. The invention defined in claim 1, wherein said carriage pivots about its center of gravity toward and away from said rails.

3. The invention defined in claim 1, wherein said platform pivots about its center of gravity towards and away from said axles.

4. The invention defined in claim 1, wherein said first and second means comprise a piston in a mating hydraulic cylinder, one of which is pivotally attached to the center portion of said carriage and the other of which is pivotally attached to the center portion of said platform.

5. The invention defined in claim 4, wherein said piston is attached to said platform and said cylinder is attached to said carriage.

6. The invention defined in claim 4, wherein said piston and cylinder are aligned vertically between the center of gravity of said carriage and the center of gravity of said platform.

7. The invention defined in claim 1, wherein said first and second means comprise a plurality of pistons and mating hydraulic cylinders aligned in a vertical plane passing through both of said centers of gravity.

8. The invention defined in claim 7, wherein said plane is parallel to said axles.

9. The invention defined in claim 8, wherein said pistons are pivotally connected to said platform and said cylinders are pivotally connected to said carriage.

10. The invention defined in claim 1, wherein said first and second means are connected to the central portions of said platform and said carriage.

11. Apparatus for grinding a pair of parallel rails, comprising:

A. a rigid vehicle carriage which moves in response to the contour and position of said rails comprising two pairs of axle-mounted wheels that travel on said rails, a pair of longitudinally extending parallel beams connecting said axles, and means spanning said beams adjacent to their center;

B. a plurality of circular rail grinding discs, each of which rotates about a generally vertical axis, said discs being supported by a massive platform having its center of gravity vertically aligned with the center of gravity of said carriage; and C. means for supporting said grinding discs independently of the movement of said vehicle caused by imperfections in the surface of said rails, comprising:

1. a pair of hydraulic cylinders having their lower ends hinged to the center portion of said carriage in a manner that permits pivoting of said carriage toward and away from said rails, 2. a pair of pistons mating with said cylinders, the upper ends of said cylinders being hinged to the center portion of said platform in a manner that permits pivoting of said platform about its center of gravity toward and away from said axles; and 3. said centers of gravity and said mating pistons and cylinders occupying the same transverse vertical plane, whereby said platform and carriage are universally relatively movable with respect to each other about said centers of gravity.

* * * * *